US006247340B1

(12) United States Patent
Lindqvist et al.

(10) Patent No.: US 6,247,340 B1
(45) Date of Patent: Jun. 19, 2001

(54) FLUID BASED CLEANING METHOD AND SYSTEM

(75) Inventors: Kenneth Lindqvist, Skarpnäck; Orvar Svensson, Täby, both of (SE)

(73) Assignee: AGA AB, Lidingo (SE)

( * ) Notice: Subject to any disclaimer, the term of this patent is extended or adjusted under 35 U.S.C. 154(b) by 0 days.

(21) Appl. No.: 09/578,205

(22) Filed: May 24, 2000

Related U.S. Application Data

(62) Division of application No. 09/161,928, filed on Sep. 28, 1998, now Pat. No. 6,073,292.

(51) Int. Cl.[7] ..... D06F 43/08; B08B 3/10

(52) U.S. Cl. ..... 68/18; 68/18 R; 68/207; 134/107

(58) Field of Search ..... 8/158; 68/18 R, 68/18 C, 18 F, 207; 134/10, 12, 107, 108

(56) References Cited

U.S. PATENT DOCUMENTS

| | | | |
|---|---|---|---|
| 5,232,476 | 8/1993 | Grant . | |
| 5,267,455 | 12/1993 | Dewees et al. | 68/18 C X |
| 5,538,025 | 7/1996 | Gray et al. . | |
| 5,772,783 | 6/1998 | Stucker . | |
| 5,904,737 | 5/1999 | Preston et al. | 68/18 C X |
| 5,970,554 | 10/1999 | Shore et al. | 8/158 |

FOREIGN PATENT DOCUMENTS

| | | |
|---|---|---|
| 0 919 659 A2 | 6/1999 | (EP) . |
| WO 97/33031 | 9/1997 | (WO) . |

*Primary Examiner*—Philip R. Coe
(74) *Attorney, Agent, or Firm*—Pearne & Gordon LLP

(57) ABSTRACT

A method for cleaning or sterilizing objects in a liquid fluid cleaning system comprising a high-pressure storing/working vessel, a cleaning chamber, and a low-pressure supply vessel, the method comprising the steps of loading the cleaning chamber with objects to be cleaned or sterilized; supplying cleaning fluid to the cleaning chamber from the low-pressure supply vessel by means of pressure difference; supplying cleaning fluid to the cleaning chamber from the high-pressure storing/working vessel; cleaning the objects in the cleaning chamber with the cleaning fluid; transferring cleaning fluid from the cleaning chamber to the high-pressure storing/working vessel; and unloading the cleaned objects from the cleaning chamber.

17 Claims, 2 Drawing Sheets

FLUID BASED CLEANING METHOD AND SYSTEM

This application is a division of U.S. application Ser. No. 09/161,928, filed Sep. 28, 1998, and now U.S. Pat. No. 6,073,292.

BACKGROUND OF THE INVENTION

The present invention relates to a fluid based cleaning method and system, particularly for the cleaning of garments, fabrics, substrates, complex materials or the like, but also for sterilizing purposes. More specifically, the invention relates to the supplying of a cleaning fluid, particularly liquid carbon dioxide, pure or with additives, to a customer application system of said cleaning system.

Conventional dry-cleaning devices use solvents, which are risky as regards health and safety, and environmentally detrimental. For example, perchlorethylene is possibly carcinogen, while petroleum based solvents are flammable and produce smog.

Liquid carbon dioxide has been proposed as a dry-cleaning fluid, see, e.g., U.S. Pat. No. 5,784,905 and No. 5,683,473 issued to Townsend al. and to Jureller et al., respectively, and references therein.

Liquid carbon dioxide has many attractive properties for use as a dry-cleaning medium; it is an inexpensive and unlimited natural resource, that is non-toxic, nonflammable, and does not produce smog, or deplete the ozone layer. It does not damage fabrics or dissolve common dyes, and exhibits solvating properties typical of hydrocarbon solvents.

A typical liquid carbon dioxide based dry cleaning system includes a confined high-pressure chamber for containing liquid carbons dioxide in liquid phase, at typical process temperatures of about 0° to 30° C., and at typical pressures of 35 to 70 bar. A high-pressure tank or reservoir is provided for supplying liquid carbon dioxide to the confined chamber. The carbon dioxide solvent may contain various additives, such as surfactants, antistatic agents, fragrance and deodorizing agents. The confined chamber may include a basket or a drum to hold the objects to be cleaned. There may be provided an agitation means or some other means for agitate or move the liquid carbon dioxide relative to the objects. Example of such a liquid carbon dioxide dry cleaning system is discussed in said U.S. Patents and in U.S. Pat. No. 5,467,492 issued to Chao et al.

When using such a cleaning system the solvent is "consumed", i.e., and, even though the solvent to some extent may be decontaminated through filtering, it will finally become useless and has then to be purified, e.g., through distillation.

A problem with this kind of dry-cleaning system is that nonavoidable losses of carbon dioxide to the atmosphere arises as a consequence of opening the cleaning chamber for loading and unloading of objects. Also, other types of losses occur during operation, e.g., due to venting of non-condensed carbon dioxide to the atmosphere. These losses are troublesome, as the dry-cleaning device needs a certain amount of carbon dioxide to operate properly.

Prior art liquid carbon dioxide dry-cleaning systems solves this by dimension the high-pressure tank or reservoir so that there is enough carbon dioxide for a predetermined number of cycles. Then carbon dioxide has to be supplied to the drycleaner. This is generally performed at regular time intervals, e.g., every second week, by delivery of carbon dioxide from a mobile tank, e.g., a tank lorry., A problem, here, is that the tank/reservoir gets very large, and as a result the dry-cleaner becomes bulky and as a consequence, difficult to place.

Very compact dry cleaners, where restrictions are put on the size of the tank/reservoir, would need delivery of carbon dioxide very frequently; or would otherwise suffer from malfunction due to lack of carbon dioxide.

Another problem is that the pressure in the tank/reservoir is higher than the most common pressure in tanks for distribution of carbon dioxide or carbon dioxide based products. A higher pressure, sufficient for filling the tank/reservoir, could be achieved by, for example, using a high-pressure delivery tank, which, however, will be heavy and reduce the capacity of the truck for other goods.

An alternative is to use a pump installed either at the delivery tank, which will be costly, noisy and hard to operate, particularly when a small distrbution tank is used, or at the customer place (dry-cleaner system) and connected to a low pressure tank to which the liquid from the delivery tank is filled, which will be costly because a pump is needed, and also higher maintenance costs are expected.

SUMMARY OF THE INVENTION

It is an object of the present invention to provide an easy, fast, and convenient method for supply of a cleaning fluid, particularly carbon dioxide, or a carbon dioxide based fluid, from a low-pressure customer supply system to a high-pressure customer application system (dry-cleaning device).

It is a further object of the invention to provide a fluid based cleaning system, which eliminates the problems associated with the prior art as discussed above.

These objects, among others, are fulfilled, according to one aspect of the present invention, by a method for supplying low-pressure liquid cleaning fluid to a high-pressure cleaning/sterilizing system comprising a high-pressure storing/working vessel, a cleaning chamber, and a compressor. The method comprises supplying liquid cleaning fluid to the cleaning chamber from a low-pressure supply vessel by means of differential pressure, and transferring gaseous cleaning fluid from the cleaning chamber to the high-pressure storing/working vessel by means of the compressor.

Preferably, the step of transferring comprises condensing the gaseous cleaning fluid before entering it into the high-pressure storing/working vessel.

According to a second aspect of the present invention, there is provided a method for cleaning or sterilizing objects in a liquid fluid cleaning system comprising a high-pressure storing/working vessel, a cleaning chamber, and a low-pressure supply vessel. The method comprises loading the cleaning chamber with objects to be cleaned or sterilized, supplying cleaning fluid to the cleaning chamber from the low-pressure supply vessel by means of pressure difference, supplying cleaning fluid to the cleaning chamber from the high-pressure storing/working vessel, cleaning the objects in the cleaning chamber with the cleaning fluid, transferring cleaning fluid from the cleaning chamber to the high-pressure storing/working vessel, and unloading the cleaned objects from the cleaning chamber.

According to a third aspect of the present invention, there is provided, in a liquid fluid based cleaning system, comprising a high-pressure customer application system including a cleaning chamber and a storing/working tank interconnected via a first tube system, a method for the cleaning or sterilizing of objects, e.g., garments, fabrics, substrates, complex materials or the like. The method comprises loading the objects to be cleaned or sterilized into the cleaning chamber; closing the cleaning chamber; evacuating major part of the air in the cleaning chamber; supplying a predetermined amount of cleaning fluid, pure or with additives, to the cleaning chamber from a customer supply system including a low-pressure liquid supply tank with cleaning fluid, pure or with additives, of a pressure higher than the present cleaning chamber pressure via a second tube system by simply, during a predetermined period of time, opening a valve of said second tube system; cleaning or sterilizing the objects by, during a predetermined period of time, circulating cleaning fluid, pure or with additives, or by agitating the objects; emptying the cleaning chamber from major part of the cleaning fluid by transfer it to the storing/working tank; opening the cleaning chamber, and thereby letting a predetermined amount of cleaning fluid leave the application system, which amount corresponds mainly to the supplied amount of cleaning fluid or to the supplied amount of cleaning fluid divided by some integer; and unloading the cleaned or sterilized objects.

Preferably carbon dioxide is chosen as the cleaning fluid.

According to a fourth aspect of the present invention there is provided a fluid based cleaning system, which implements the above aspects of the present invention.

An advantage of the present invention is that the need of frequent delivery of cleaning fluid from a mobile delivery unit is eliminated.

Another advantage of the invention is that an ordinary (low-pressure) delivery system for cleaning fluid, particularly carbon dioxide, could be used, i.e., there is no need of high pressure delivery from a high pressure distribution vessel, through increasing pressure by a pump co-located with the distribution vessel or, through increasing pressure by a pump dedicated for this purpose and installed in the cleaning system.

Yet another advantage of the invention is that the application system (the washing machine) may be made very compact with the storing/working tank and the cleaning chamber equal in size, or the storing/working tank only slightly larger.

Still another advantage of the invention is that since a smaller volume of cleaning fluid is existing in the application system, a smaller volume has to be distilled.

BRIEF DESCRIPTION OF THE DRAWINGS

The above and other objects, features and advantages of the present invention will become apparent from the detailed description given hereinbelow and the accompanying FIGS. 1–2 which are given by way of illustration only, and thus are not limitative of the present invention.

DETAILED DESCRIPTION OF THE INVENTION

In the following description, for purposes of explanation and not limitation, specific details are set fourth, such as particular applications, techniques, etc. in order to provide a thorough understanding of the present invention. However, it will be apparent to one skilled in the art that the present invention may be practiced in other versions that depart from these specific details. In other instances, detailed descriptions of well-known methods and devices are omitted so as not to obscure the description of the present invention with unnecessary details.

Figure 1:
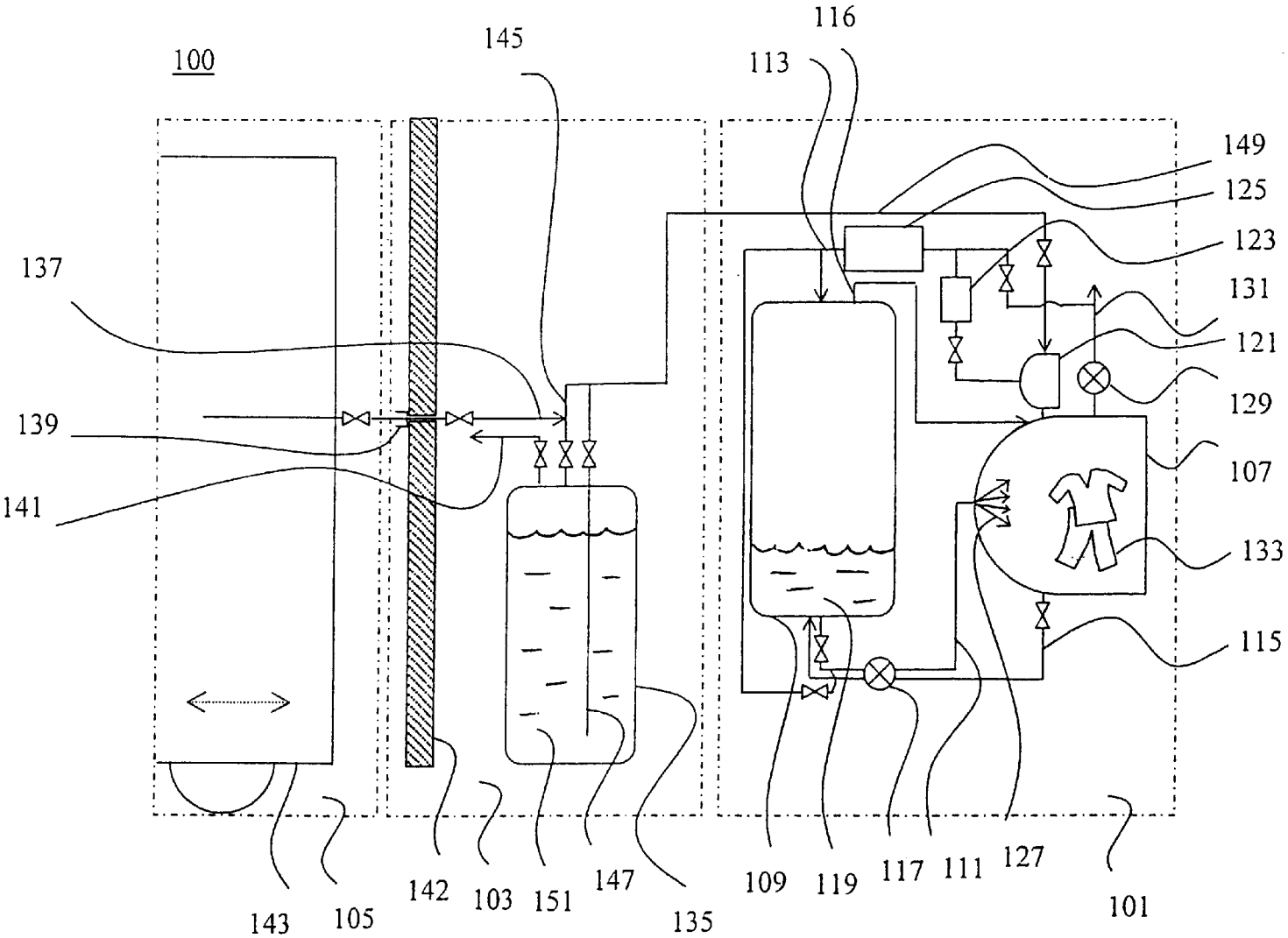
FIG. 1 shows an embodiment of the liquid carbon dioxide based cleaning system according to the present invention.

With reference to FIG. 1, a liquid carbon dioxide based cleaning system 100 in accordance with an exemplary embodiment of the present invention, comprises a high-pressure customer application system 101 and a customer supply system 103. Here, low pressure indicates a pressure from 5,2 up to approximately 20–30 bar while high pressure indicates a pressure from 20–30 up to 70 bar. Shown is also a distribution unit 105, which does not form part of the cleaning system, but is an essential part for the provision of carbon dioxide to the system. The application system 101, which, preferably, constitutes an integrated cleaning apparatus, or in short, a washing machine, comprises as main parts a cleaning vessel or chamber 107 and a storing/working vessel or tank 109 interconnected by a tube system 111, 113, 115, 116. A pump 117 is provided connected to tubes 111, 115 for pumping carbon dioxide 119 from the storing/working tank 109 to the cleaning chamber 107 and vice versa and/or for circulating carbon dioxide within the cleaning chamber. Interconnected in tube 113 between the cleaning chamber and the storing/working tank is in order, counted from the cleaning chamber, a lint trap 121, a filter 123 and a cooler or condenser 125.

The lint trap 121 may be separate (as in the Figure) or forming an integral part of the cleaning vessel. The filter and the condenser may be of any suitable form as known in the art. The tube 111 used for pumping carbon oxide to the cleaning vessel has an outlet 127 consisting of a sprinkler system or the like which directs the carbon dioxide in thin jets entering the cleaning vessel in predetermined angles.

Finally, the customer application system may include a further pump or compressor 129 connected to the cleaning vessel through a further tube system 131, e.g., for evacuation of the cleaning vessel. All tubes and tube systems have valves at appropriate locations (not all shown in FIG. 1), of which some or all may be controlled, e.g., electronically or hydraulically through some automatic control system known in the art.

Typical sizes of the cleaning chamber is 300–400 liters, but could differ substantially depending on the customer application, while the storing/working tank is at least of the same size, preferably, slightly larger than the cleaning chamber and the tube system. The tubes are of quite small dimensions ranging typically from. 1 to 2 inches in diameter. Advantageously, temperatures range from 0° to 30° C. and pressures from 30 to 70 bar in the cleaning chamber.

Furthermore, the application system may comprise agitating means and/or heating means, as well as a rotating drum or basket for holding the objects to be cleaned (not shown in the Figure). Temperature and pressure controllers (not shown in the Figure) may be provided for controlling the temperature and pressure of the liquid carbon dioxide within the cleaning chamber.

The application system 101 is operated in a manner as now is to be discussed. During cleaning, carbon dioxide is circulated several turns from the storing/working tank 109 via tube 111 to the cleaning chamber 107 and back to the storing/working tank 109 via tube 113. To function properly, the system according to FIG. 1, should, during cleaning, contain carbon dioxide at least to the extent that the cleaning chamber 107 and/or tube system 111, 113 are/is completely filled with liquid carbon dioxide. The minimum limitation of the amount of liquid may also be set by good operation of pump 117, by maximum cleaning cycle time, by cleaning performance etc.

A cleaning cycle may comprise the following steps, starting with the cleaning chamber open. Note that it is not indicated everywhere and every time a valve is to be opened or closed in order to clarify the depiction. However, for any person skilled in the art this would be obvious.

1. Loading objects 133 that are to be cleaned into the cleaning chamber. Objects that the present invention is applicable to include garments, fabrics, substrates, complex materials, equipment or the like. The system is suitable for cleaning in a wide sense, which, consequently, includes, e.g., laundering, washing, scrubbing, degreasing, decontaminating, sanitizing, disinfecting and sterilizing.
2. Closing the cleaning chamber.
3. Evacuating the air (most of it) in the cleaning chamber by lowering the pressure in the cleaning chamber to a predetermined level, e.g., by pumping with compressor 129. The predetermined level is chosen so as to avoid any unnecessary delay time of the cycle due to pumping. However, it is not desirable to have large amounts of air entered into the application system.
4. Pressurizing the cleaning chamber with gaseous carbon dioxide to a predetermined pressure, e.g. 5–6 bar. This is preferably performed through tube 116.
5. Cleaning the objects by, during a predetermined period of time, e.g., 3–15 minutes, circulating carbon dioxide, pure or with additives. Pump 117 is used to pump liquid carbon dioxide from tank 109 through tube 111 and outlet 127 into the cleaning vessel 107. The carbon dioxide is then passed lint trap 121 and filter 123 through tube 113. In lint trap 121 and filter 123 dirt and other particles from the objects are filtered out. Finally the liquid carbon dioxide is passed through cooler or condenser 125, where the carbon dioxide is cooled to compensate for the energy supplied, e.g., by pump 117, cleaning chamber 107 and the tube systems, and finally returned to back into tube 111. The liquid may pass storing/working tank 109 during circulation, but it is not necessary. The flow into the cleaning chamber is typically 150 liters/min and the additives may comprise surfactants, antistatic agents, odorizing and/or deodorizing addings, etc. As an alternative, or in addition, to said circulation, agitating means, a movable drum or basket, and/or any other means may be used to agitate the liquid and/or the objects.
6. Emptying the cleaning chamber from liquid carbon dioxide by transfer (pumping) it through tube 115 by pump 117 to storing/working tank 109.
7. Pumping major part of the gaseous carbon dioxide by compressor 121 via tube 131 to cooler/condenser 125. Also, at this step the pumping is terminated at some predetermined finite pressure. Clearly, one would like to pump vacuum as this would not lead to any losses of carbon dioxide (see step 8), but just as in step 3 one has to find a practical level (e.g. 5–6 bar) to stop at.
8. Venting and opening cleaning chamber 107. Here, any residual carbon dioxide is leaving the cleaning chamber and gets mixed with ambient air.
9. Unloading the cleaned objects 133. A typical duration of the complete cleaning cycle is typically 40 minutes.

It is unavoidable that some carbon dioxide is lost to the ambient air in every cleaning cycle. This loss is estimated to be 2–3 kg per cycle. After a number of cycles the amount of carbon dioxide in the application system is too low for a proper operation, particularly in a compact system, where the storing/working tank is only slightly larger than the cleaning chamber.

The cleaning cycle, or in short, wash, may be repeated many times a day. For instance, in a laundry or a dry-cleaning establishment 5–15 cycles per day would not be exceptional. The system may in this case be degraded after a certain period of time depending on the ratio of the storing/working tank volume and the cleaning chamber volume. This is clearly a problem, as distribution is normally not performed this frequent. It would be too costly.

Also it is a problem that the pressure in the storing/working tank is higher than the most common pressure in tanks for distribution of carbon dioxide or carbon dioxide based products.

In accordance with the principles of the present invention a low-pressure supply system for the provision of carbon dioxide is proposed.

Again with reference to FIG. 1, the low-pressure supply system or customer supply system 103 comprises a low-pressure liquid supply vessel or tank 135, and a filling means, including yet another tube system 137 connected to the liquid supply tank and an outdoors mounted connection socket 139 connected to the far end of tube system 137. Furthermore, there is a venting tube 141 connected to the liquid supply tank. Typically, the liquid supply tank is 300 liters and vacuum insulated, and contains carbon dioxide 151, with or without additives, of a pressure of about 10–20 bar, but the pressure may be higher, see below.

The connection socket is preferably mounted on the outer wall 142 of the building in which the cleaning system is installed. The liquid supply tank may be filled with liquid carbon dioxide from a dedicated low-pressure distribution unit, comprising a mobile tank 143, at appropriate time intervals, e.g, of one or two weeks (when the liquid supply tank is empty).

The low-pressure liquid supply tank 135 is connected to the application system, e.g. to lint trap 121 as shown in FIG. 1 or, alternatively, directly to cleaning chamber 107, through a tube system 145, 147, 149. According to the invention the supply system is arranged to provide the carbon dioxide that is consumed (lost). This is preferably performed between step 4 and 5 as discussed above. At this very moment the pressure of the carbon dioxide 151 in the liquid supply tank is considerably higher than the pressure in the lint trap/cleaning chamber, so a predetermined amount of carbon dioxide is transferred to the lint trap/cleaning by simply, during a predetermined period of time, opening a valve of tube system 145, 147, 149. The predetermined amount should correspond to the lost amount if the transfer is to take place once every cleaning cycle.

As an option, carbon oxide is transferred every n'th cycle and then mainly of an amount corresponding to n times the amount that is lost every cleaning cycle.

Preferably, the cleaning system is arranged to transfer the carbon dioxide, completely, or at least to a major extent, in its liquid phase.

As an option, the pump or compressor 129 is used to speed up the filling of carbon dioxide or to make it possible to transfer more carbon dioxide per cycle. Here, gaseous carbon dioxide is transferred from the cleaning chamber to the high-pressure storing/working tank 109. Advantageously, the gaseous carbon dioxide is condensed before entering into the storing/working tank. This option is also very convenient when filling the cleaning system the first time or after a larger leak.

Tube system 145, 147, 149 comprises advantageously a flexible hose system with a hose diameter chosen so that heat losses to the system are kept to a minimum, given a predetermined longest time period of transfer. A suitable hose diameter ranges preferably from a few to ten millimeters.

The low-pressure liquid supply tank may be located remote from the application system to allow for installation of the application system in a cramped space. If a hose system is employed the application system may even be movable within reasonable limits.

Still with reference to FIG. 1, tube system 145, 147, 149 comprises a first 145 and a second 147 tube, said first tube being mounted at the upper part of the liquid supply tank, i.e., in contact with gaseous carbon dioxide in the liquid supply tank and said second tube second tube being a dip tube, i.e., in contact with liquid carbon dioxide in the liquid supply tank. Both tubes are then connected to the lint trap/cleaning chamber via tube 149.

Preferably, the carbon dioxide is provided to the lint trap/cleaning chamber in a way that now is to be described. Provided that tube system 145, 149 is filled with gaseous carbon dioxide, mainly liquid carbon dioxide is supplied to the lint trap/cleaning chamber through, during a predetermined period of time, opening a valve of dip tube 147 and a valve of tube 149. The supplying is terminated by opening valve of tube 145, closing valve of tube 147, to flow gaseous carbon dioxide through tube 149, whereafter valve of tube 147 is closed followed by closing valve of tube 145. In this way it is assured that tube 149 is filled with gaseous carbon dioxide when not being used for supplying.

This method of providing carbon dioxide to the lint trap/cleaning chamber is particularly advantageous when the carbon dioxide contains at least one additive (with a boiling point higher than that of carbon dioxide).

It should be noted that the low-pressure insulated liquid supply tank 135 also could be a high-pressure tank. The pressure in such a tank may be kept on a demanded (low) level by, during operation, filling sufficient gaseous carbon dioxide into the lint trap/cleaning chamber; otherwise will heat leaks to the surroundings causing the pressure to rise substantially. Particularly, during delivery, the pressure in the supply tank has to be low in order to make it possible to fill the supply tank from the low-pressure delivery tank 143.

Figure 2:
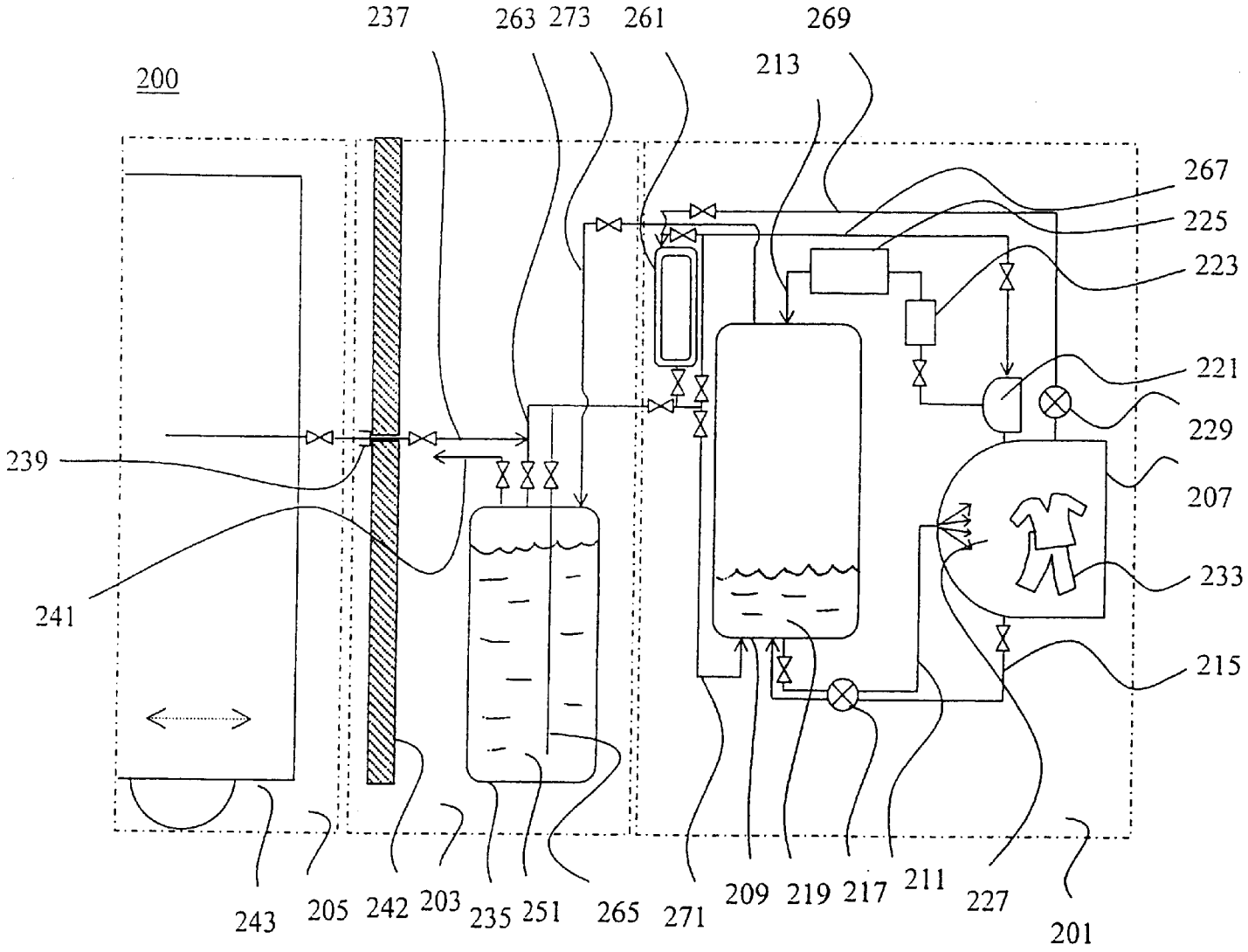
FIG. 2 shows a second embodiment of the liquid carbon dioxide based cleaning system according to the invention.

With reference now to FIG. 2, another exemplary liquid carbon dioxide based cleaning system 200 according to the present invention, comprises a customer application system 201 and a customer supply system 203. Details and features of this embodiment that correspond, exactly or approximately, to ones of previous embodiment are given reference numerals with the two last figures identical to the ones of FIG. 1.

Consequently, the exemplary high-pressure customer application system 201 comprises a cleaning vessel or chamber 207 for loading and unloading objects 233 to be cleaned, a storing/working vessel or tank 209, a tube system 211, 213, 215 with valves, pumps 217, 229 for pumping the carbon dioxide 219, a lint trap 221, a filter 223 and a cooler 225. The lint trap 221 may, as discussed above, be an integral part of the cleaning vessel. Tube 211 used for pumping carbon oxide to the cleaning vessel has an outlet 227.

Similarly, the low-pressure customer supply system 203 comprises a low-pressure liquid supply vessel or tank with carbon dioxide 251, and a filling means, including a tube system 237, a connection socket 239 mounted on wall 242, and a venting tube 241.

Finally, a low-pressure distribution unit 205 comprising a mobile tank 243, which at time intervals, preferably regular, fills the liquid supply tank 235 with carbon dioxide.

This second exemplary embodiment is distinguished from the first embodiment as regards following. An isolated high-pressure liquid bottle 261, whose size is considerable smaller than that of the liquid supply tank, e.g., 30–40 liters defined by consumption of carbon dioxide and chosen frequency of filling, is located in the application system 203 (as shown in FIG. 2), separate or as an integral part of washing machine 205–227, but it may, alternatively, be located in the customer supply system 203. A tube and valve manifold 263–271 interconnects the isolated liquid bottle 261, the liquid supply tank 235, the lint trap 221/cleaning vessel 207, pump 229, and the storing/working tank 209.

It is clearly much easier to isolate the small liquid bottle 261, and it is filled, continuously or repeatedly, with liquid carbon dioxide from the liquid supply tank 235 through tubes 263, 265, and contains, accordingly, carbon dioxide in only/mostly liquid phase.

The carbon dioxide may, in this embodiment of the present invention, be supplied to application system 201 from liquid bottle 261 using mainly two different approaches.

The first approach is similar to the supplying in accordance with the first embodiment of the present invention. Consequently, liquid carbon dioxide of a predetermined amount is transferred to lint trap 221/cleaning vessel 207 at a moment when the pressure in the lint trap-vessel system is lower than the pressure in the liquid bottle, preferably when objects to be cleaned have been loaded and air in the vessel has been evacuated, by, during a predetermined period of time, opening a valve/valves of tube 267. The predetermined amount is estimated to compensate for any losses in the application system; these are dependent on type and size of application system, class of products to be cleaned, capacity need, etc.

The second approach utilizes pump 229 of the application system to transfer liquid carbon dioxide from low-pressure bottle 261 to high-pressure storing/working tank 209. Pump 229 applies a pressure in tube 269, which at a certain level, presses out liquid carbon dioxide from liquid bottle 261 through tube 271 and into storing/working tank 209.

Alternatively, instead of transferring the liquid carbon dioxide to high-pressure storing/working tank 209, it may be transferred to tube system 211, 213, 215, or into any suitable part of the customer application system.

Thus, by using an isolated and insulated high-pressure bottle 261 and sufficient tubing it will be possible to, at any time in the cleaning cycle, fill up and empty the bottle. By heating the bottle or using compressor 229 could also the pressure in the bottle be increased to an equal, or higher, pressure than in the customer application system, which increases the flexibility in where to fill carbon dioxide into the customer application system.

The cleaning system 200 may also include yet another tube system 273, including a pressure reducing means, e.g, a pressure reducing valve, and interconnecting the upper part of the high-pressure storing/working tank (i.e., where the tank contains gaseous carbon dioxide of high pressure) and the low-pressure liquid supply tank. Hereby, the pressure of the low-pressure liquid supply tank may be kept above a predetermined level. Preferably, the valve reduces the tank pressure of approximately 50 bar to, e.g., 15 bar.

The invention being thus described, it will be obvious that the same may be varied in a plurality of ways. Such variations are not to be regarded as a departure from the scope of the invention. All such modifications as would be obvious to one skilled in the art are intended to be included within the scope of the appended claims. Particularly, the cleaning solvent may, instead of carbon dioxide, be any suitable kind of cleaning fluid.

What is claimed is:

1. A liquid fluid based cleaning system for cleaning or sterilizing an object comprising:

a high-pressure storing/working tank for storage of cleaning fluid of high pressure;

a cleaning chamber for housing said object to be cleaned or sterilized, said cleaning chamber being connected to said storing/working tank;

a device for transferring cleaning fluid from said storing/working tank to said cleaning chamber, for cleaning or sterilizing said object housed in said cleaning chamber, and for transferring cleaning fluid from said cleaning chamber to said storing/working tank, wherein some cleaning fluid is left in said cleaning chamber;

a device for venting residual cleaning fluid in said cleaning chamber into ambient air;

a low-pressure supply vessel connected to said cleaning chamber, said supply vessel containing cleaning fluid of low pressure; and a device for opening the connection between said supply vessel and said cleaning chamber to transfer low-pressure cleaning fluid from said supply vessel to said cleaning chamber by means of pressure difference to compensate for cleaning fluid lost from the cleaning chamber during venting.

2. A liquid fluid based cleaning system as claimed in claim 1, wherein said device for venting lowers the pressure within said cleaning chamber to a pressure lower than the pressure within said low-pressure supply vessel.

3. A liquid fluid based cleaning system as claimed in claim 1, wherein said device for venting lowers the pressure within said cleaning chamber to atmospheric pressure.

4. A liquid fluid based cleaning system as claimed in claim 3, wherein the cleaning fluid within said low-pressure supply vessel has a pressure between 5.2 bar and approximately 20–30 bar.

5. A liquid fluid based cleaning system as claimed in claim 4, wherein said device for opening is a valve device.

6. A liquid fluid based cleaning system as claimed in claim 1, wherein said device for transferring cleaning fluid from said storing/working tank to said cleaning chamber, for cleaning or sterilizing said object housed in said cleaning chamber, and for transferring cleaning fluid from said cleaning chamber to said storing/working tank, includes a pump for pumping of cleaning fluid in liquid phase.

7. A liquid fluid based cleaning system as claimed in claim 6, wherein said device for transferring cleaning fluid from said storing/working tank to said cleaning chamber, for cleaning or sterilizing said object housed in said cleaning chamber, and for transferring cleaning fluid from said cleaning chamber to said storing/working tank, includes a compressor for transferring cleaning fluid in gaseous phase from said cleaning chamber to said storing/working tank.

8. A liquid fluid based cleaning system as claimed in claim 2, further comprising a condenser for condensing the cleaning fluid in gaseous phase before being entered into said storing/working tank.

9. A liquid fluid based cleaning system as claimed in claim 1, wherein said cleaning chamber includes a door for accessing the interior of said cleaning chamber to load and unload said object to be cleaned or sterilized.

10. A liquid fluid based cleaning system as claimed in claim 9, wherein said device for venting is said door of the cleaning chamber.

11. A liquid fluid based cleaning system as claimed in claim 1, wherein said low-pressure supply vessel is connected to said cleaning chamber by means of a tube arrangement, said tube arrangement system including a first tube ending at an upper part of said supply vessel such that said first tube is facing gaseous cleaning fluid in said supply vessel, a second tube ending at a lower part of the supply vessel or being a dip tube, such that said second tube is facing liquid cleaning fluid in said supply vessel, and a main tube connecting the respective one of the first and second tubes with the cleaning chamber.

12. A liquid fluid based cleaning system as claimed in claim 11, wherein said device for opening is adapted to transfer liquid cleaning fluid to said cleaning chamber via said second tube and to thereafter fill said main tube with gaseous cleaning fluid.

13. A liquid fluid based cleaning system as claimed in claim 1, further comprising:

an isolated liquid bottle connected to said supply vessel and said cleaning chamber, the size of said liquid bottle being considerable smaller than the size of said low-pressure supply vessel; and wherein said device for opening includes:

a device for filling said isolated liquid bottle with cleaning fluid from said low-pressure supply vessel by means of pressure difference; and a device for transferring cleaning fluid from said isolated liquid bottle to said cleaning chamber.

14. A liquid fluid based cleaning system as claimed in claim 13, further comprising a device for increasing the pressure within the filled isolated liquid bottle to a pressure higher than the pressure within said high-pressure storing/working tank, and wherein said device for transferring cleaning fluid from said isolated liquid bottle to said cleaning chamber is adapted to perform the transfer via said high-pressure storing/working tank.

15. A liquid fluid based cleaning system as claimed in claim 1, wherein the low-pressure supply vessel is located remote from said storing/working tank and from said cleaning chamber to allow for installation of said storing/working tank and said cleaning ch amber in a cramped space.

16. A liquid fluid based cleaning system as claimed in claim 1, wherein said low-pressure supply vessel includes a filling socket through which cleaning fluid can be supplied from a distribution unit including a mobile low-pressure tank.

17. A liquid fluid based cleaning system as claimed in claim 1, further comprising a tubing including a pressure reducing means, particularly a pressure reducing valve, said tubing interconnecting said high-pressure storing/working tank and said low-pressure supply vessel.

* * * * *

UNITED STATES PATENT AND TRADEMARK OFFICE

CERTIFICATE OF CORRECTION

PATENT NO. : 6,247,340 B1
DATED : June 19, 2001
INVENTOR(S) : Kenneth Lindqvist et al.

It is certified that error appears in the above-identified patent and that said Letters Patent is hereby corrected as shown below:

Column 1,
Line 35, please delete “carbons” and insert therefor -- carbon --;
Line 67, please delete “lorry.,” and insert therefor -- lorry. --;

Column 9,
Line 56, please delete “2,” and insert therefor -- 7, --; and

Column 10,
Line 48, please delete “ch amber” and insert therefor -- chamber --.

Signed and Sealed this

Sixth Day of August, 2002

*Attest:*

*Attesting Officer*

JAMES E. ROGAN
*Director of the United States Patent and Trademark Office*